United States Patent [19]

McStravick

[11] Patent Number: 4,457,379

[45] Date of Patent: Jul. 3, 1984

[54] METHOD AND APPARATUS FOR OPENING DOWNHOLE FLAPPER VALVES

[75] Inventor: David M. McStravick, Houston, Tex.

[73] Assignee: Baker Oil Tools, Inc., Orange, Calif.

[21] Appl. No.: 350,906

[22] Filed: Feb. 22, 1982

[51] Int. Cl.[3] ..... E21B 34/14

[52] U.S. Cl. ..... 166/373; 166/317; 251/354

[58] Field of Search ..... 166/373, 377, 386, 317, 166/328, 188, 153, 154, 156; 251/349, 354; 175/247, 248

[56] References Cited

U.S. PATENT DOCUMENTS

| | | | |
|---|---|---|---|
| 2,278,780 | 4/1942 | Harrington et al. | 175/248 |
| 2,742,093 | 4/1956 | Vaughn | 166/188 |
| 3,065,793 | 11/1962 | Page | 166/373 X |
| 3,376,935 | 4/1968 | Baker | 166/317 |
| 4,154,303 | 5/1979 | Fournier | 166/317 |
| 4,160,484 | 7/1979 | Watkins | 166/317 |

*Primary Examiner*—Ernest R. Purser
*Assistant Examiner*—Thuy M. Bui
*Attorney, Agent, or Firm*—Norvell & Associates

[57] ABSTRACT

The disclosure provides a method and effecting the noncontact opening of a flapper valve disposed downhole in a well. Such flapper valves may be located below a seal bore in a downhole tool such as a packer. An annular housing having external seals engagable with the seal bore can be positioned within the downhole tool. Fluid circulation through the annular housing during insertion is permitted by a ball valve mounted in its axial bore and engagable with a downwardly facing sealing surface. Upon engagement of the seals on the annular housing with the seal bore, the housing is converted into a piston and the amount of force exerted on trapped fluid between the annular housing and the flapper valve may be adjusted by adding weight from the tubing string. Fluid pressure above the flapper valve is increased to a level exceeding the closing forces on the flapper valve and the valve opens without any mechanical contact being made therewith. Subsequently the annular housing may be passed downwardly through the flapper valve and is expanded into the bottom of the well by dropping a ball into engagement with an upwardly facing sealing surface on the annular housing and increasing the fluid pressure above the ball to a level sufficient to shear the shearable connection between the annular housing and the production tool.

9 Claims, 4 Drawing Figures

METHOD AND APPARATUS FOR OPENING DOWNHOLE FLAPPER VALVES

BACKGROUND OF THE INVENTION

1. Field of the Invention

The invention relates to a method and apparatus for effecting the noncontact opening of a flapper valve disposed downhole in a well by developing an intermediate pressure force which reduces the force needed to open the valve and minimizes the possibility of damage to the flapper valve when significant well pressures are maintaining it in a closed position.

2. Description of the Prior Art

Conventional packers used in subterranean wells often incorporate a spring-loaded flapper valve on the bottom of the packer just below the cylindrical seal bore of the packer. When a production tool or production tubing is pulled from the packer, the flapper valve is shifted to its closed position by the spring. Well fluid pressures below the packer thus act to increase the closing forces on the flapper valve so that the combination of the spring force and the fluid pressure forces amount to a substantial bias on the flapper valve maintaining it in its closed position.

When it is desired to reinsert a production tool or production tubing through the packer, it has been common to utilize an irregular mule shoe end on the inserted tool. It often happens that the lowermost point of the mule shoe end of the production tool contacts the flapper valve at a position very close to the hinge of the valve, hence at a position where little effective leverage is exerted on the flapper valve. When the flapper valve is retained in its closed position by a substantial well fluid pressure, the application of sufficient downward force to the mule shoe to effect the opening of the flapper valve will instead shear the pivot pin mounting of the flapper valve, hence resulting in significant damage, possibly forcing the shut down of the well to replace the packer and the broken flapper valve.

It is therefore desirable to effect the opening of a downhole flapper valve, at least to the extent of relieving fluid pressure across the valve, through the application of fluid pressure forces which unlike mechanical contact forces cannot act only adjacent the flapper hinge.

SUMMARY OF THE INVENTION

The preferred embodiment of this invention provides a method and apparatus for effecting the noncontact opening of a downhole flapper valve, which may be attached to a conventional packer, by a mechanically produced, fluid pressure force. An actuating piston comprising an annular housing is shearably secured to the end of a production tool or string and lowered into the well. The annular housing defines a fluid passage therethrough and has a downwardly facing check valve sealing surface, such as an annular ball seating surface surrounding such fluid passage. A check valve member such as a ball is mounted in the housing for vertical movements and effects a seal with the sealing surface only in its upward position. Fluids can thus be readily circulated in a downward direction through the annular housing as it is being lowered into the well.

The annular housing is further provided with at least one external annular seal designed to effect a sealing engagement with the internal cylindrical seal bore in a packer located at a position above the flapper valve.

However, as the housing is being lowered into the well, any fluids in the well can readily pass around the periphery of the external annular seal since no sealing engagement is effected until the annular housing enters the internal cylindrical seal bore of the packer.

Upon entering the cylindrical seal bore of the packer, the external seal on the annular housing effects a sealing engagement with the internal cylindrical seal bore of the packer and the annular housing thus effectively converts into a piston which, by manipulation of the production string, imposes a downward pressure force on the fluid trapped in the packer above the closed flapper valve. The amount of pressure generated by the annular housing is determined by the amount of force applied to the housing through the tubing string. Hence the fluid pressure of the trapped fluid above the closed flapper valve may be gradually increased by the addition of additional weight to a level that equals and then exceeds the combined closing forces exerted on the closed flapper valve by both the closing spring and the pressure of well fluids below the valve. Hence, the valve will be shifted, solely by fluid pressure forces, to a partially open position without any mechanical contact being made with the flapper valve. The resultant pressure force acting to open the valve will act along the same centerline as the well pressure urging the valve closed.

The annular housing is then lowered through the flapper valve, moving it to its fully open position, and such downward movement is continued until the external seals on the annular housing are below the internal cylindrical seal bore and the normal external seals on the end of the production tool or production string are engaged with such seal bore. At this point, a second ball is dropped into the well and seats on an upwardly facing annular sealing surface provided in the upper portions of the annular housing. Fluid pressure within the production tubing string is then increased to impose a substantial downward force on the second ball and the annular housing relative to the production tube or tubing. Such force effects the shearing of the shear pins securing the annular housing to the production tube or tubing and the actuating piston is expended through the bottom of the well.

Further objects and advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1:
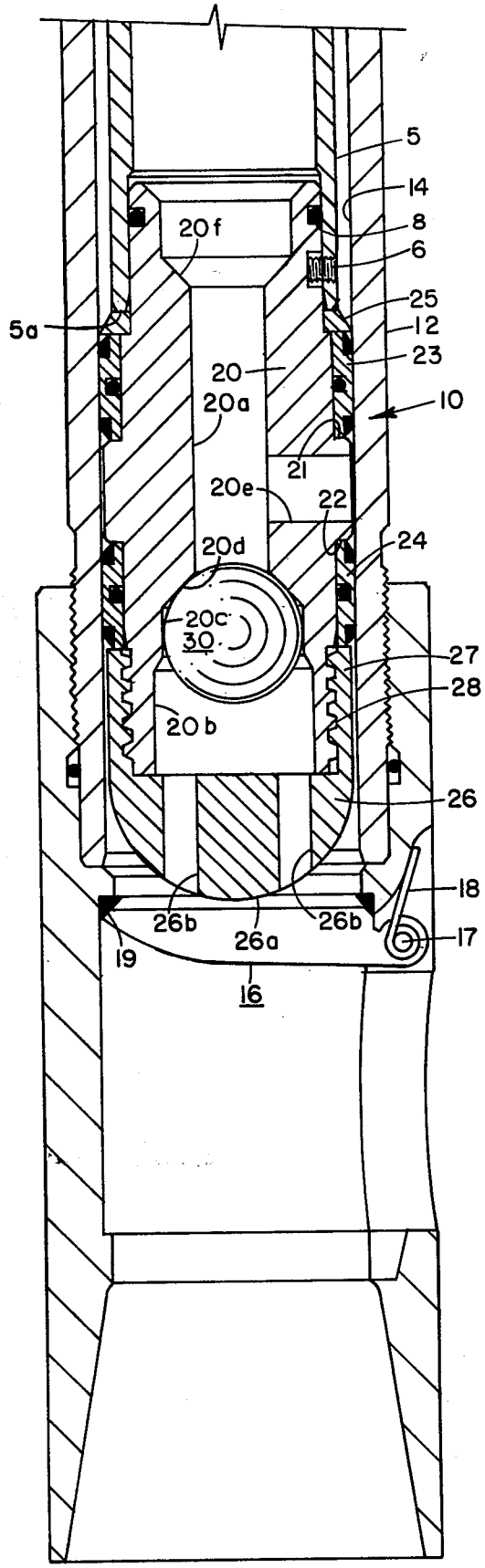
FIG. 1 is a vertical sectional view of a valve opening apparatus embodying this invention shown in the initial run-in position of the apparatus.
Figure 2:
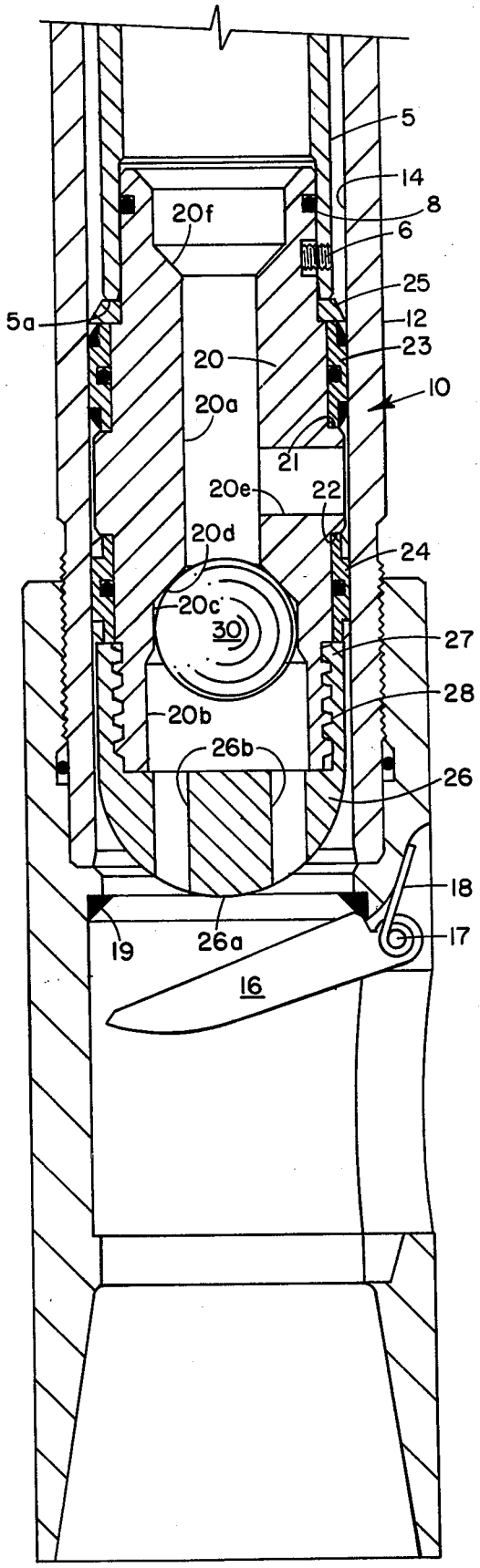
FIG. 2 is a view similar to FIG. 1 showing the initial opening of the flapper in response to the pressure above the flapper.

Referring to the drawings, the numeral 10 represents a conventional packer assembly including a packer body 12 defining a cylindrical seal bore 14. Below the seal bore 14, a flapper valve 16 is conventionally pivotally mounted in the packer body 12 on a transverse pin 17 and is biased to its closed position by a torsion spring 18. In its closed position, the perimeter of the upper surface of the flapper valve 16 sealingly engages an annular seal 19 which is conventionally mounted in the packer body 10. Thus, in its closed position, the flapper valve 16 is subject to fluid pressure forces of any well fluids flowing into the well below the flapper valve, and such fluid pressure further tends to maintain the flapper valve 16 in its closed position.

To effect the noncontact opening of the flapper valve 16, an actuating device including an annular housing 20 is provided having its upper end shearably connected to the bottom end of a production string or tool 5 by a plurality of peripherally spaced shear screws 6 and an O-ring 8 seals the connection. The central portion of the annular housing 20 is of enlarged diameter, providing upwardly and downwardly facing shoulders 21 and 22 respectively. Conventional external annular molded seals 23 and 24 are respectively mounted in surrounding relationship to the annular housing 20 and in abutment with the upwardly and downwardly facing surfaces 21 and 22. The upper seal 23 is maintained against axial displacement by a force transmitting ring 25 which in turn is clamped in position by the bottom end **5*a* of the production tool 5**.

The lower seal 24 is axially secured in its position by an internally threaded, annular flange 27 formed on the upper end of a bulbous shaped cap 26. Cap 26 is threadably secured to threads 28 provided on the bottom end of the annular body 20. The cap 26 is provided with a semispherical bottom surface **26*a* and is further provided with a plurality of axially extending fluid passages 26*b* which communicate with an enlarged counterbore 20*b* formed in the end of the bore 20*a* of the annular housing 20. Above the counterbore 20*b*, a slightly reduced counterbore 20*c* is provided terminating upwardly in a downwardly facing annular sealing surface 20*d***.

A ball 30 is dimensioned to freely move vertically within the counterbores **20*b* and 20*c* and effect a sealing engagement with the downwardly facing annular sealing surface 20*d* in response to an upward flow of fluid through the bulbous cap 26 and into the bore 20*a* of the annular body 20. In the embodiment shown, ball 30 is free to rest on the bottom of counterbore. Alternatively, the ball may be spring loaded relative to bulbous cap 26 with the ball being spaced from cap 26 and seating surface 20*d*. Additionally, in the event that circulation around the annulus defined by the production string is desired during the run-in of the production tool 5, a relatively large radial aperture 20*e* is provided in the wall of annular body 20 at a position above the ball valve seating surface 20*d* and between seals 23 and 24**.

Lastly, the upper end portion of the annular housing 20 is provided with an upwardly facing annular sealing surface **20*f*** which is adapted to achieve a sealing engagement with a sealing element, such as a ball, to be dropped into the well at a particular stage in the operation of the valve opening device.

In operation, the annular housing 20 is lowered into the well on the bottom end of the production tool 5 and, while it is thus being lowered, unimpaired circulation of fluid through the annular body can occur, since the external annular seals 23 and 24 are not in sealing engagement with any surface. Thus, either forward or reverse circulation can be accomplished during the insertion movement.

When the annular housing 20 of the actuating device reaches the top of the packer body cylindrical seal bore 14 the bulbous shaped end surface **26*a* of the cap 26 will assist in guiding the annular housing 20 into the cylindrical seal bore 14 and the external annular seals 23 and 24 will successively effect a sealing engagement with the cylindrical seal bore 14. Since there is always some fluid above the flapper valve 16, the descending movement of annular housing 20 will trap this fluid below seals 23 and 24, with the fluid entering cap passages 26*b* and the counterbores 20*b* and 20*c*, thus forcing the ball 30 into sealing engagement with the downwardly facing annular sealing surface 20*d***.

Once the ball 30 seats, the annular housing 20 is effectively converted into a piston and the application of additional weight to the annular housing 20 by the production string will achieve ever increasing fluid pressure within the fluid trapped above the closed flapper valve 16. The resultant downward force on the flapper valve is directed along the axis of packer body 12, hence has a significant displacement from the pivot pin 17. This resultant pressure force will act along the same line as the pressure tending to keep the flapper closed. The pressure of the trapped fluid is thus increased to generate a downward force that equals and then exceeds the total of the upward forces exerted on the flapper valve 16 by its spring 18 and the well fluids, so that the flapper valve will be forced downwardly, off its seat, to a partially open position by the higher fluid pressure existing above it.

Figure 3:
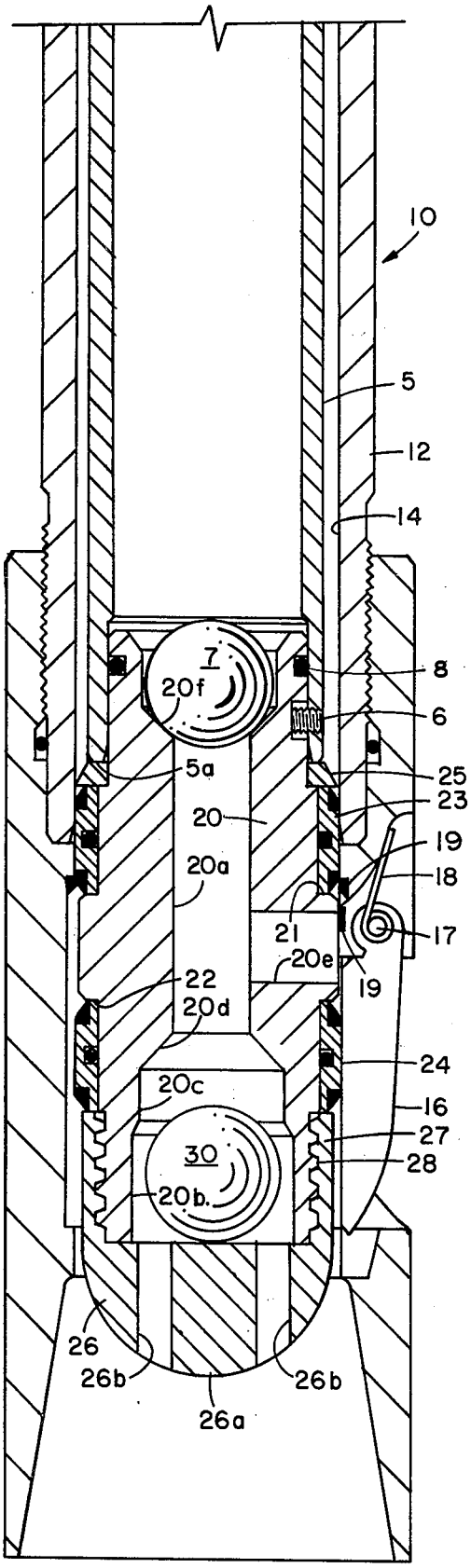
FIG. 3 is a view similar to FIG. 2 but showing the valve shifted to the fully open position of the flapper valve.

Once the flapper valve 16 has moved off its seat and the pressure across the valve has been equalized, the annular housing 20 may be moved downwardly through the flapper valve, bringing the external tubing seals (not shown) conventionally provided at the lower end of the production tool 5 or of a tubing string into sealing engagement with the packer seal bore 14 and fully opening the flapper valve 16 (FIG. 3). Although not shown, the downward movement of the housing 20 is preferably continued until the seals 23 and 24 on annular body 20 move out of engagement with the seal bore 14.

Figure 4:
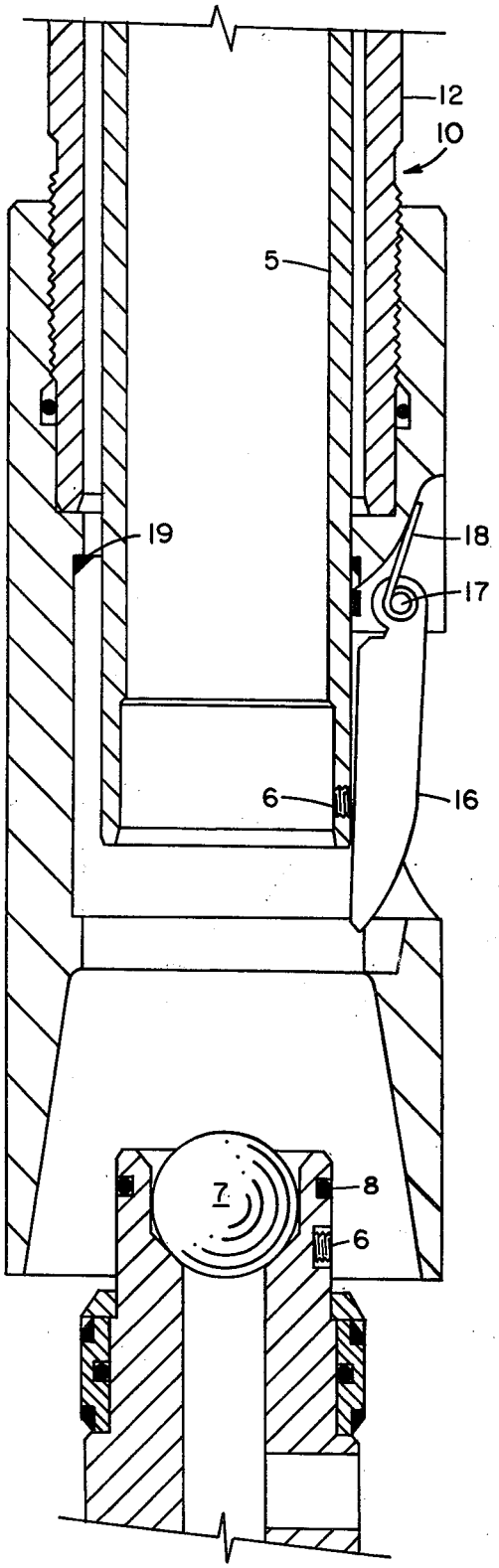
FIG. 4 is a view similar to FIG. 2 but showing the elements of the flapper actuating device in the position assumed after the full opening of the flapper valve and the expending of the opening apparatus down into the well.

A second ball 7 formed of "Kirksite" or similar readily sealable material is then dropped into the well through the bore of the production string and comes to rest on the upwardly facing annular surface **20*f* provided in the annular housing 20. Fluid pressure is then increased in the bore of the production tubing to produce a downward force on the annular housing 20 relative to the production tool 5 sufficient to effect the shearing of the shear screws 6, following which the entire assemblage contained in the annular housing 20 is free to be expended into the lower portions of the well (FIG. 4) and the well is ready for production or whatever other operations are then desired, with the flapper valve 16 being held in its open position by the portion of the tubing or production tool 5 extending through the flapper as illustrated in FIG. 4**.

The method embodied in this invention is readily apparent from the foregoing description of the operation of the device. It will be apparent that the flapper valve 16 is initially moved to a partially open position purely by fluid pressure forces applied by the piston action of the annular housing 20. After being partially opened, the rounded bottom surface 26a of the bulbous shaped cap 26 engages the flapper valve 16 to push it to its fully opened position illustrated in FIG. 3. Obviously, both of these movements of the flapper valve are readily accomplished without any risk of damage to the flapper valve or shearing of its mounting pin.

Although this invention is employed with a packer, the invention embodied in this flapper actuator device can be employed with any downhole tool incorporating a flapper. For example, this invention could be employed to open the flapper on a flapper-type safety valve.

While the invention has been particularly described in connection with the opening of a flapper valve by an apparatus secured to the bottom end of a production string or a production tool, those skilled in the art will recognize that the opening apparatus may be applied and operated by a work string or wire line. In the case of wire line operation, weights would have to be applied to the top of the valve opening apparatus to provide sufficient force to generate the required fluid pressure to open the flapper valve. Accordingly, the term "conduit" adopted in the claim is intended to refer to any type of production string, work string or wire line on which the valve opening apparatus is carried into the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of opening a downhole hinged flapper valve disposed in a closed position in a subterranean well with the pressure below the flapper valve acting to keep the flapper valve closed, comprising the steps of:

(1) positioning a check valve above the closed flapper valve, the check valve preventing upward fluid flow therethrough;

(2) moving the check valve toward the closed flapper to trap fluid between the check valve and the flapper valve; and (3) applying a downward force on the check valve greater than the force acting to keep the flapper valve closed, with additional force on the check valve increasing the pressure of the fluid between the check valve and the flapper valve until the pressure force acting to open the flapper valve exceeds the force acting to keep the flapper valve closed.

2. The method of opening a downhole flapper valve disposed in a closed position adjacent a fluid passage defined in part by an internal cylindrical seal bore, comprising the steps of:

(1) shearably securing an annular housing to a conduit, said housing having an external seal cooperable with the seal bore, and a check valve in the bore of the annular housing shiftable to close fluid passage through said annular housing in one direction;

(2) positioning the annular housing with the external seal engaging the cylindrical seal bore, thereby closing the check valve and trapping fluid between the check valve and the flapper valve;

(3) applying additional force to the annular housing to increase the pressure of the trapped fluid between the check valve and the flapper valve sufficient to exert a force on the flapper valve in excess of the forces holding it in closed position, thereby partially opening the flapper valve;

(4) moving the annular housing through the flapper valve to fully open the flapper valve; and (5) applying a force to said annular housing relative to the conduit to shear its securement to the conduit, thereby releasing the annular housing from the conduit.

3. The method of opening a downhole flapper valve disposed in a closed position below a fluid passage defined in part by an internal cylindrical seal bore comprising the steps of:

(1) shearably securing an annular housing to the end of a tubular string, said housing having an external seal cooperable with the seal bore, a check valve in the bore of the annular housing shiftable upwardly to close fluid passage upwardly through said annular housing, and an upwardly facing annular sealing surface on the upper end of the annular housing;

(2) lowering the annular housing into the well to engage the external seal with the cylindrical seal bore, thereby causing fluid trapped above the flapper valve to rise through the annular housing and close the check valve;

(3) applying weight to the annular housing to increase the pressure of the trapped fluid above the flapper valve sufficient to exert a downward force on the flapper valve in excess of the forces holding it in closed position, thereby partially opening the flapper valve;

(4) moving the annular housing downwardly through the flapper valve to fully open the flapper valve;

(5) dropping a sealing element into the well to seat on said upwardly facing annular sealing surface; and (6) applying fluid pressure to the sealing element to shear the annular housing from the tubular string and expend same into the lower portions of the well.

4. Apparatus for opening a downhole hinged flapper valve disposed in a closed position in a subterranean well, with pressure on one side of the flapper valve acting to keep the flapper valve closed, comprising: annular check valve means for trapping fluid between said check valve means and said flapper valve; a tubular member; and means for affixing said check valve means to said tubular member, said check valve means being movable toward said flapper valve upon movement of said tubular member relative to said flapper valve with the increasing pressure force exerted by said trapped fluid on the flapper valve eventually exceeding the forces holding said flapper valve in the closed position.

5. Apparatus for opening a downhole hinged flapper valve located below a cylindrical seal bore in a downhole tool in a subterranean well; with pressure below the flapper valve acting to keep the valve closed; comprising: an annular housing; a passage in said annular housing permitting the fluid flow therethrough; check valve means for closing said passage when said annular housing is within the cylindrical seal bore to trap fluid between said check valve means and said flapper valve; and means for moving said check valve means toward said flapper valve with the increasing pressure force exerted by said trapped fluid on the flapper valve eventually exceeding the forces holding said flapper valve in the closed position.

6. Apparatus for opening a downhole flapper valve disposed in a closed position in a fluid passage having an internal cylindrical seal bore located above the flapper valve comprising, in combination: an annular housing; means for shearably connecting said annular housing to a conduit; at least one external annular seal on said housing adapted to sealingly cooperate with the cylindrical seal bore; a downwardly facing annular sealing surface in the bore of said annular housing; a valve element vertically shiftably mounted in said housing and engagable with said downwardly facing annular sealing surface to block upward fluid flow through said annular housing, whereby the engagement of said external annular seal with the cylindrical seal bore converts said annular housing to a piston compressing fluid trapped above the closed flapper valve sufficiently to partially open the flapper valve and permit the annular housing to be moved downwardly through the flapper valve; and means on said annular housing responsive to an increase in fluid pressure in the conduit to impose a shearing force on said shearable connecting means.

7. Apparatus for opening a downhole flapper valve disposed in a closed position in a fluid passage having an internal cylindrical seal bore located above the flapper valve comprising, in combination: an annular housing; means for shearably connecting said annular housing to a tubular string; at least one external annular seal on said housing adapted to sealingly cooperate with the cylindrical seal bore; a downwardly facing annular sealing surface in the bore of said annular housing; a ball vertically shiftably mounted in said housing and engagable with said downwardly facing annular sealing surface to block upward fluid flow through said annular housing, whereby the engagement of said external annular housing to a piston compressing fluid trapped above the closed flapper valve sufficiently to partially open the flapper valve and permit the annular housing to be moved downwardly through the flapper valve; and an upwardly facing, annular sealing surface on the upper end of said annular housing adapted to receive a dropped ball in sealing relation after opening of the flapper valve, whereby an increase in fluid pressure in the tubular string will effect the shearing of said shearable connecting means.

8. The apparatus of claim 6 or 7 wherein said one external annular seal on said housing is secured to the lower end of said housing by a depending bulbous cap, said cap having a vertical aperture to permit fluid flow into the bore of said annular housing.

9. Apparatus for opening a hinged flapper located adjacent the end of a downhole packer with a cylindrical bore therethrough in a subterranean well where the pressure below the packer acts to keep flapper valve closed, comprising: an annular housing; means for attaching said annular housing to a conduit; a passage in said annular housing for permitting fluid flow therethrough as said conduit and housing descend in said well above said packer; and check valve means for closing said passage when said annular housing is within the cylindrical bore of said packer to trap fluid between said check valve means and said flapper valve with further movement of said check valve means toward said flapper valve increasing the pressure of the trapped fluid acting to open said flapper valve.

* * * * *